United States Patent [19]

Shibano et al.

[11] 3,936,170

[45] Feb. 3, 1976

[54] ELASTIC ELECTROCONDUCTIVE PRODUCT

[75] Inventors: Hiroshi Shibano; Iizaka Isao, both of Toyokawa, Japan

[73] Assignee: Minolta Camera Kabushiki Kaisha, Osaka, Japan

[22] Filed: July 19, 1973

[21] Appl. No.: 380,923

[30] Foreign Application Priority Data

Aug. 1, 1972 Japan ..... 47-77455

[52] U.S. Cl. ..... 355/3 R; 29/132; 252/511; 252/512; 174/1; 317/262 A; 96/1 TE

[51] Int. Cl. ..... G03g 15/00

[58] Field of Search ..... 117/232, 212, 8, 218, 216, 117/224, 230, 226, 227, 17.5, 26, 27, 94, 111 R, 98; 96/1.5; 29/132; 252/500–502, 503, 510, 511, 512; 96/1 C; 101/131, 473; 355/85, 110

[56] References Cited

UNITED STATES PATENTS

| | | | |
|---|---|---|---|
| 2,980,834 | 4/1961 | Tregay et al. | 96/1 C |
| 3,043,684 | 7/1962 | Mayer | 252/501 |
| 3,118,789 | 1/1964 | Wiswell et al. | 117/213 |
| 3,395,636 | 8/1968 | Hess | 29/132 |
| 3,609,104 | 9/1971 | Ehrreich et al. | 252/511 |
| 3,629,774 | 12/1971 | Crites | 117/226 |
| 3,787,208 | 1/1974 | Jones | 252/501 |
| 3,798,032 | 3/1974 | Miller | 117/218 |

*Primary Examiner*—Charles E. Van Horn
*Assistant Examiner*—Michael N. Ball
*Attorney, Agent, or Firm*—Wolder & Gross

[57] ABSTRACT

A product comprising a soft elastic base material and an electroconductive film formed on the base material by applying a coating composition to the base material and fixing the composition by an insolubilizing treatment such as irradiation with light, heating or the like, the composition comprising an aqueous solution of polyvinyl alcohol, a fine powder of electroconductive material dispersed therein and an insolubilizing agent for insolubilizing the polyvinyl alcohol by the insolubilizing treatment. The composition may contain a softener to impart softness to the electroconductive film. The soft elastic base material is made of a spongy foamed material and fixed to the peripheral surface of a base roller.

5 Claims, 4 Drawing Figures

ELASTIC ELECTROCONDUCTIVE PRODUCT

BACKGROUND OF THE INVENTION

This invention relates to an elastic electroconductive product, more particularly to an elastic product which has been rendered electroconductive for use as electrical materials and as rollers for transferring electrostatic latent images in electrophotographic copiers, the elastic electroconductive product comprising a soft elastic material such as rubber, synthetic resin or the like and an electroconductive film formed thereon and having a desired electric resistivity for example in the range of $10^{12}$ to $10^{2}$ ohms.

Conventionally known are elastic products which have been rendered electroconductive for use as electroconductive rollers and belts in electrophotographic copiers, printing presses, spinning machines, etc. for antistatic purposes or for injection of electric charges. Such electroconductive products are prepared by mixing or kneading an antistatic agent predominantly comprising an anionic, cationic, nonionic or ampholytic surfactant with a soft elastic material such as natural rubber, synthetic rubber or synthetic resin and shaping the mixture. With these products, the hygroscopic or electroconductive properties of the surfactant are utilized.

Electroconductive products of another type are also known which are prepared by shaping an elastic material such as described above and incorporating therein a fine powder of carbon black or metal such as aluminum, silver, nickel, copper or the like for antistatic purposes. These electroconductive products therefore utilize electroconductive properties of carbon black, metal or the like.

However, the elastic products thus rendered electroconductive generally have a relatively high electric resistivity of $10^{12}$ to $10^{9}$ ohms and are not fully effective in antistatic or charge injecting action for example as an electrostatic latent image transfer roller referred to above which must have a sufficiently low resistivity.

Since it is impossible to lower the electric resistivity of the electroconductive elastic product to the desired value only by mixing or kneading an antistatic agent such as surfactant with the elastic base material, there is a need to incorporate a large amount of finely divided electroconductive material. The electric resistivity will then be reduced, but the addition of the fine powder impairs the softness of the elastic electroconductive product obtained, rendering the elastic product harder and brittle to reduce its elasticity a great deal. Consequently, when used for example as the transfer roller, the product fails to assure an elastic, uniform contact pressure over a long period of time against copy paper or like opposing member with which it comes into contact.

In other words, there has been a limitation on the amount of the antistatic agent or electroconductive material to be added to rubber or like soft elastic material for the improvement of the electroconductivity thereof.

To assure an especially elastic, uniform contact pressure, a spongy elastic product having a low electric resistivity may be made by adding great amounts of a highly electroconductive material such as metal powder and a foaming agent such as ammonium carbonate, diazoaminobenzene, hydrazide benzensulfonate or the like to a synthetic rubber or like elastic material and foaming the resulting mixture, but the fine metal powder markedly reduces the elasticity of the resulting spongy product and its ability to contact intimately. Thus it is impossible to obtain a sponge-like elastic product having numerous uniform pores therein.

It is also known to form an electroconductive film by applying to a base material an electroconductive coating composition comprising epoxy resin and silver or the like dispersed therein with an organic solvent. However, this method is expensive and has the drawback that the organic solvent is inflammable and harmful to the human body because of its toxicity and attacts rubber or like base material.

The electroconductive member such as a roller for transferring electrostatic latent image in an electrophotographic copier is intentionally biased to inject an electric charge from the ground into charged copy paper or like opposing member. It is therefore desired that electrically the conductive member have a relatively low resistivity, for instance, of $10^{8}$ ohms, preferably $10^{5}$ ohms, while mechanically it must be adapted for contact with the opposing member under uniform pressure to bias the same by injection of an electric charge without permitting uneven injection of charge due to the frictional resistance of an irregular surface. Moreover, it must have soft and elastic properties equivalent to or exceeding those of usual rubber (up to about 50° SR) so as not to damage the opposing members (copy paper and pinch roller) when brought into contact therewith.

SUMMARY OF THE INVENTION

An object of this invention is to provide an elastic product which has been rendered electroconductive and which is soft and elastic, assures a uniform contact pressure against an opposing member, has the desired electric resistivity imparted thereto and abrasion resistance, the product being capable of retaining these desired properties over a prolonged period of time.

Another object of this invention is to provide a spongy elastic product which has been rendered electroconductive and which has a large area for contact with opposing members including copy paper and is uniform in its electric resistivity at any portion of the contact area.

Another object of this invention is to provide a sponge roller having a low resistivity for use in an electrophotographic copier to transfer electrostatic latent images without permitting uneven injection of charge into the opposing members.

According to this invention, the electroconductive elastic product has an electroconductive film formed on a soft elastic base material.

The electroconductive film is formed on the base material by applying a coating composition to the base material and fixing the composition to the base material by an insolubilizing treatment such as irradiation with light, heating or the like, the composition comprising an aqueous solution of polyvinyl alcohol, and suitable amounts of a fine powder of electroconductive material dispersed therein and an insolubilizing agent for insolubilizing the polyvinyl alcohol by the insolubilizing treatment.

The soft elastic materials to be used are rubber, synthetic resin and like elastic materials. Usually, they are preferably spongy shaped materials including open-cellular foamed materials which can be impregnated with the composition when applied as above, permitting the composition to penetrate into the cells or pores of the foamed material. The spongy materials include those formed with numerous pores by mechanical means. However, if the elastic material has a small surface for contact with the opposing member or a short length of contact portion, the pores need not be formed.

In the case where the electroconductive elastic product is supported on a base roller for use as an electrostatic latent image transfer roller, the product can be adhered to the base roller to render the roller electroconductive, but the foaming treatment for the elastic material should preferably be conducted on the base roller serving as a core member when it is shaped into the roller. This assures a great advantage to provide a roller having very accurate dimensions.

To impart improved softness to the electroconductive film of the elastic electroconductive product, the coating composition may incorporate a nonvolatile softener having a great amount of hydroxyl groups and miscible with polyvinyl alcohol uniformly.

The elastic electroconductive product of this invention has the desired electric resistivity within the wide range of $10^{12}$ to $10^{2}$ ohms that is determined by varying the proportion of the electroconductive material such as fine powder of carbon black or metal contained in the electroconductive film.

By using an elastic material which is in the form of an open-cellular foamed material or which has been formed with numerous pores by mechanical piercing means, the electroconductive film on the surface of the elastic material can be electrically connected, through the electroconductive film lodged in the pores by impregnation, to a metal roller serving as a support for the elastic material.

If the pitch of the pores is smaller than the thickness of the elastic product, there will be hardly any difference in electric resistivity throughout the surface of the elastic product. Thus the fluctuations in the resistivity will be eliminated.

However within a range of small area where the difference in resistivity is virtually negligible, for example in the case of a very short electroconductive roller such as a grounding roller, the pores need not be provided.

According to this invention, the electroconductive film is fixed to the elastic material very firmly and the film is formed on the surface of the elastic material uniformly. Accordingly, there will be no uneven injection of charge.

The composition for forming the electroconductive film does not attack the elastic base material, is not detrimental to the softness and elasticity of the material, does not render the product brittle and hard over a prolonged period of time and gives a film having very excellent resistance to abrasion and water and high durability.

Inasmuch as the film has considerable softness and strength, the film, even if bonded to a spongy base material which deforms greatly when subjected to a mechanical force, will remain bonded to follow the deformation without peeling, irrespective of the amount of the fine electroconductive powder. Thus the product assures the desired electric properties, softness and elasticity, maintains a uniform contact pressure against the opposing members without causing damage thereto.

The polyvinyl alcohol and other materials to be used in this invention are relatively easy to obtain, inexpensive, soluble in water and do not attack the spongy base material and are free of hazard of toxicity and fire since they do not include organic solvent.

When fixedly supported on a metal roller, the electroconductive product of this invention is usable as a developing roller, powder image transfer roller, electrostatic latent image transfer roller, electrode roller, roller for removing electric charge from a sheet or the like for electrophotographic copiers. If supported on and bonded to an electroconductive plate or sheet, it can be used as a transfer plate, antistatic plate or electrode plate as well as for various applications.

Other objects and features of this invention will become more apparent from the following description.

DESCRIPTION OF THE PREFERRED EMBODIMENTS

Figure 1:
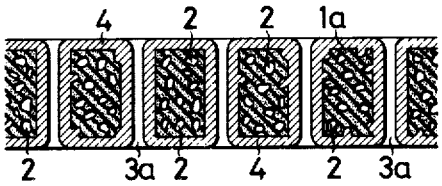
FIG. 1 is a fragmentary enlarged view in section schematically showing an embodiment of spongy elastic electroconductive product according to this invention which gives a very soft, uniform contact pressure and which has an especially large contact area.

FIG. 1 shows a closed-cellular foamed material 1*a* having numerous closed cells 2 and formed with numerous minute piercing pores 3*a* opened on the front and rear surfaces and formed by mechanical means. The foamed material 1*a* is coated with an electroconductive film 4 formed by applying an aqueous solution of polyvinyl alcohol containing an insolubilizing agent, softener and fine electroconductive powder and subjecting the resulting coating to an insolubilizing treatment by irradiation with light, heating or the like to fix the coating. Thus the material 1*a* is impregnated with the solution, with the solution penetrating into the pores 3*a*.

Figure 2:
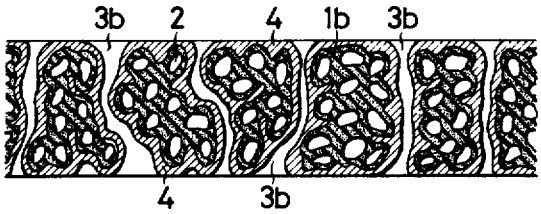
FIG. 2 is a view showing another embodiment and corresponding to FIG. 1.

FIG. 2 shows an elastic product which has been rendered electroconductive by fixedly forming the electroconductive film 4 in the same manner as above on a spongy foamed material 1*b* used as an elastic material and having closed cells 2 and open cells 3*b*.

The spongy foamed materials 1*a*, 1*b* or soft elastic material used as the base for the electroconductive elastic product include natural rubber, soft and elastic synthetic rubbers such as polyacrylic rubber, ethylene-propylene rubber, nitrile-butylene rubber, neoprene rubber, styrene-butylene rubber, polybutadiene rubber, polyisoprene rubber, urethane rubber, silicone rubber, fluorine-contained rubber and the like, soft and elastic synthetic resins such as polyurethane, vinyl chloride, nylon, polyethylene, polypropylene and the like. The soft elastic materials may preferably be open-cellular spongy shaped materials. Especially if they have a wide area, it is essential that they have the pores 3*a* or open cells 3*b*.

Examples of the fine electroconductive powder to be added to the aqueous solution of polyvinyl alcohol are fine carbon black powder, fine metal powder and like electroconductive materials.

Usable as the insolubilizing agent for insolubilizing polyvinyl alcohol by irradiation with light or heating are tetrazonium salt, diazido compound and diazonium salt which undergo cross-linking reaction or etherification to insolubilize polyvinyl alcohol when irradiated with visible rays, ultraviolet rays, X-rays, electron rays, gamma rays and like activating radiation or when heated. Alternatively, highly polymerized polyvinyl alcohol may be selected. Also usable are those that can be formalized, benzalized, acetalized or butyralized with formalin, benzylaldehyde, acetic anhydride, butyraldehyde or the like.

When the aqueous solution of polyvinyl alcohol containing a diazonium salt or diazido compound and a fine electroconductive powder dispersed therein is applied to the elastic material, dried and then irradiated with light, the light causes cross-linking to render the polyvinyl alcohol insoluble in water. This is attributable to the fact that the photolysis of the diazonium salt produces radicals, which react with the hydroxyl groups of polyvinyl alcohol to produce ether. In other words, polyvinyl alcohol loses hydroxyl groups and becomes less soluble in water.

To this end, diazo compounds having larger molecules are effective. Further tetrazo compounds containing two diazo groups in the same molecule or diazo polymers containing more diazo groups are especially effective. Addition of a very small amount of such compound renders polyvinyl alcohol insoluble in water.

Such effect is achieved not only by the reaction between the radicals of the diazo-photolyzed product and the hydroxyl groups of polyvinyl alcohol to eliminate the hydroxyl groups but also by the fact that the diazo groups at both ends react for cross-linking, thereby changing the polyvinyl alcohol in the form of a straight chain polymer into a three-dimensional structure.

The softeners to be used to impart softness to the electroconductive film are glycerin, ethylene glycol, propylene glycol, butylene glycol, polyethylene glycol and like polyhydric alcohols which have many hydroxyl groups and are nonvolatile and miscible with polyvinyl alcohol to suitably control flocculation of the polyvinyl alcohol molecules. Generally, the softener is added to the aqueous solution of polyvinyl alcohol in a proportion of up to about 20% by weight based on the latter.

Thus the fine electroconductive powder and insolubilizing agent are added to the aqueous solution of polyvinyl alcohol, along with the softener if desired, and the resulting composition is applied to the soft elastic material, dried and then subjected to the aforementioned insolubilizing treatment to obtain an electroconductive elastic product as shown in FIGS. 1 or 2.

Given below are examples of the coating composition for forming the electroconductive film 4.

| Formulation 1 | | |
|---|---|---|
| Water | 1 | liter |
| Polyvinyl alcohol | 40 | grams |
| Glycerin | 100 | milliliters |
| Tetrazonium salt | 0.5 | gram |
| Fine powder of carbon black | 30 | grams |
| Formulation 2 | | |
| Water | 1 | liter |
| Polyvinyl alcohol | 20 | grams |
| Polyethylene glycol | 2 | grams |
| 4,4'-diazidostilbene-2,2'-disulfonic sodium salt | 1 | gram |
| Fine powder of carbon black | 100 | grams |

Each of the coating compositions was applied to a surface of urethane rubber or urethane foam rubber, activated by irradiation with ultraviolet rays and then heated to obtain an elastic product rendered electroconductive, retaining the original mechanical properties of rubber and having an electric resistivity of $1.0 \times 10^8$ ohms with Formulation 1 or $3.5 \times 10^8$ ohms with Formulation 2.

| Formulation 3 | | |
|---|---|---|
| Water | 800 | milliliters |
| Polyvinyl alcohol | 60 | grams |
| 28% ammonia water | 200 | milliliters |
| Copper sulfate | 2 | grams |
| Fine powder of carbon black | 50 | grams |

The above coating composition was applied to the surface of neoprene rubber or neoprene foam rubber, then dried and heated to obtain an elastic product rendered electroconductive, having an electric resistivity of $5.5 \times 10^6$ ohms and retaining the original mechanical properties of foam rubber.

Figure 3:
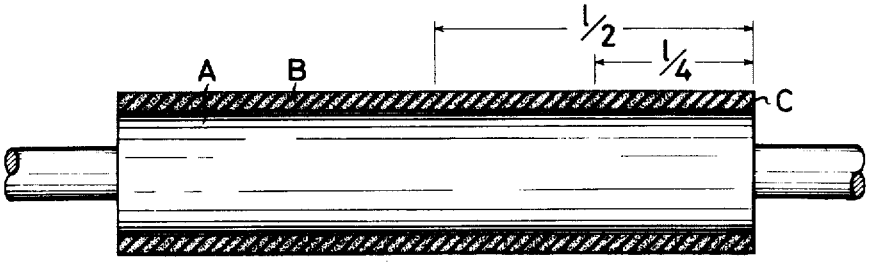
FIG. 3 is a view partly in vertical section showing the construction of an electroconductive roller according to this invention.

FIG. 3 shows an electroconductive roller comprising a metal base roller A and a spongy elastic product B which has been rendered electroconductive as described above and which is fixedly provided around the entire periphery of the roller A. Although a sheet of the electroconductive elastic product B may be wound around and adhered to the base roller A, it is difficult to obtain an electroconductive roller of accurate dimensions. Advantageously, therefore, the base roller A is disposed in a suitable molding die as a core member and unfoamed rubber in the form of liquid is placed into the die around the base roller A and is then foamed to form a spongy elastic layer thereon. After the foamed soft spongy layer has been fixed to the base roller A, the coating composition is applied, followed by the foregoing insolubilizing treatment.

With reference the roller shown in FIG. 3, suppose the elastic material has no piercing pores but is coated with the electroconductive film only over its surface. Even if the electroconductive film is low in its electric resistivity, the electric conduction is effected through the electroconductive film covering the opposite end faces C of the elastic material. Assuming that the overall length of the roller is $l$, electrical resistivities at various points on its surface will then be such that the resistivity at a point $l/2$ from C is approximately twice the resistivity at a point $l/4$ from C. If such roller is used as electrostatic latent image transfer roller, there will be a marked difference between the resistivity at its end and the resistivity at its midportion, resulting in an uneven transfer operation.

Figure 4:
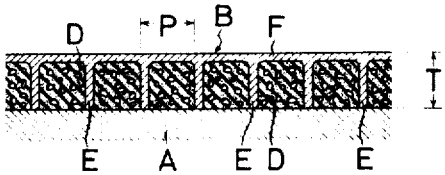
FIG. 4 is an enlarged view in section showing part of FIG. 3.

However according to this invention, the electroconductive spongy elastic product B as shown in FIGS. 1 or 2 is fixedly formed on the base roller A as schematically shown in FIG. 4 on an enlarged scale, the construction being such that the elastic product B has numerous piercing pores D opened on its front and rear faces and provided with an electroconductive film E therein so as to electrically connect the electroconductive film F on the surface of the elastic product B to the base roller A. Accordingly, at whatever point on the surface of the elastic material B, there is no substantial difference between the same and the base roller A which would result in a difference in the resistivity, with the result that the difference in electric resistivity due to the difference in distance is negligible to assure uniform electrostatic image transfer.

If the pores D which may be in the form of open cells (FIG. 2) or which may be formed by mechanical piercing (FIG. 1) are positioned at a pitch P that is smaller than the distance between the base roller A and the surface of the electroconductive spongy elastic product B, namely than the thickness of the elastic product B, the difference in the resistivity will be almost nullified at any point on the surface. Needless to say, the pitch P is preferably as small as possible.

However, as already described, within a range of small area where the difference in resistivity is practically negligible as in the case of a very short electroconductive roller like a grounding roller, the pores need not be particularly formed.

What is claimed is:

1. An electroconductive elastic member having an electrical resistivity in the range of $10^{12}$ to $10^{2}$ ohm/cm comprising:

an elastic base made of an open-cellular spongy material;

and having impregnated therein a mixture including polyvinyl alcohol, an electroconductive fine powder, an insolubilizing agent for insolubilizing said polyvinyl alcohol, and a softener having many hydroxyl groups, said softener comprising up to 20 percent by weight of said mixture and being selected from the group consisting of glycerin, ethylene glycol, propylene glycol, butylene glycol, polyethylene glycol and polyhydric alcohols, and wherein said mixture is fixedly formed on said base by irradiation with light, heating or like insolubilizing treatment.

2. The electroconductive elastic member of claim 1, wherein said electroconductive fine powder is selected from the group consisting of carbon black and metallic fine powders.

3. The electroconductive elastic member of claim 1, wherein said insolubilizing agent is selected from the group consisting of tetrazonium salt, diazido compound, and diazonium salt.

4. The electroconductive elastic member of claim 1, wherein said base is rolled on an electroconductive roller, and electroconductive channels are formed between said mixture coated on said base and said roller.

5. In an electrophotographic copying machine having a metal roller for transferring electrostatic latent images, said metal roller having fixedly supported thereon an electroconductive elastic member in accordance with claim 1.

* * * * *